US009044636B2

(12) United States Patent
Hao

(10) Patent No.: US 9,044,636 B2
(45) Date of Patent: Jun. 2, 2015

(54) TRAINING DEVICE WITH HANGING SEAT

(71) Applicant: Dyaco International Inc., Taipei (TW)

(72) Inventor: Kuo-Wu Hao, Taipei (TW)

(73) Assignee: DYACO INTERNATIONAL INC., Taipei (TW)

( * ) Notice: Subject to any disclaimer, the term of this patent is extended or adjusted under 35 U.S.C. 154(b) by 92 days.

(21) Appl. No.: 14/039,056

(22) Filed: Sep. 27, 2013

(65) Prior Publication Data

US 2014/0100085 A1 Apr. 10, 2014

(30) Foreign Application Priority Data

Oct. 5, 2012 (TW) ..... 101219337 U
Mar. 6, 2013 (TW) ..... 102204118 U

(51) Int. Cl.

| | |
|---|---|
| ***A63B 22/02*** | (2006.01) |
| ***A63B 22/00*** | (2006.01) |
| ***A63B 69/00*** | (2006.01) |
| *A63B 24/00* | (2006.01) |
| *A63B 71/00* | (2006.01) |

(52) U.S. Cl.

CPC ..... *A63B 22/02* (2013.01); *A61H 2201/1633* (2013.01); *A63B 22/0015* (2013.01); *A63B 69/0057* (2013.01); *A63B 69/0064* (2013.01); *A63B 24/0062* (2013.01); *A63B 24/0087* (2013.01); *A63B 2024/0093* (2013.01); *A63B 2071/0081* (2013.01); *A63B 2208/0233* (2013.01); *A63B 2220/51* (2013.01); *A63B 2225/09* (2013.01); *A63B 2225/093* (2013.01)

(58) Field of Classification Search

USPC ..... 482/51–52, 54, 1–9

See application file for complete search history.

(56) References Cited

U.S. PATENT DOCUMENTS

| | | | | |
|---|---|---|---|---|
| 7,494,450 | B2 * | 2/2009 | Solomon | 482/69 |
| 7,568,712 | B2 * | 8/2009 | Kovachi et al. | 280/87.021 |
| 8,523,742 | B2 * | 9/2013 | Lam et al. | 482/66 |
| 2005/0183759 | A1 * | 8/2005 | Wolfe | 135/67 |
| 2008/0194389 | A1 * | 8/2008 | Southerland | 482/54 |
| 2010/0175634 | A1 * | 7/2010 | Chang et al. | 119/700 |
| 2011/0140484 | A1 * | 6/2011 | Chang | 297/118 |
| 2012/0042917 | A1 * | 2/2012 | Workman et al. | 135/66 |

* cited by examiner

*Primary Examiner* — Stephen Crow
(74) *Attorney, Agent, or Firm* — WPAT, PC; Justin King

(57) ABSTRACT

According to an embodiment of this invention, a training device is disclosed and comprises a conveyor belt, a frame set, and a hanging seat. The conveyor belt is used for a user walks on it in place for physical medicine or rehabilitation. The frame set is arranged around the conveyor belt for providing a support. The hanging seat is hanged on the frame set for supporting the user, comprising a trunk having a front end and a rear end, a seat connected with the rear end of the trunk, and at least one belt connected with the trunk and hanged on the frame set.

17 Claims, 11 Drawing Sheets

TRAINING DEVICE WITH HANGING SEAT

CROSS-REFERENCE TO RELATED APPLICATIONS

The entire contents of Taiwan Patent Application No. 101219337, filed on Oct. 5, 2012, and Taiwan Patent Application No. 102204118, filed on Mar. 6, 2013, from which this application claims priority, are incorporated herein by reference.

BACKGROUND OF THE INVENTION

1. Field of the Invention

The present invention relates to training machines such as walk-training devices or treadmills having a hanging seat.

2. Description of Related Art

Treadmills are devices allowing a user for walking or running in the same place. Usually, treadmills provide a moving platform with a wide conveyor belt driven by an electric motor or a flywheel.

Some types of treadmills with lower speed can be used for physical medicine and rehabilitation, for example, to strengthen legs of wounded, elderly, or ill people. The user stands on the conveyor belt, holding the handrails arranged at two sides of the conveyor belt.

For wounded, elderly, or ill people, however, their strength is weak and their steps probably cannot match or even are slower than the speed of the conveyor belt, and hence are easy to falling down.

SUMMARY OF THE INVENTION

In one general aspect, the present invention relates to training machines such as walk-training device or treadmills having a hanging seat.

According to an embodiment of this invention, a training device is disclosed and comprises a conveyor belt, a frame set, and a hanging seat. The conveyor belt is used for a user walks on it in place for physical medicine or rehabilitation. The frame set is arranged around the conveyor belt for providing a support. The hanging seat is hanged on the frame set for supporting the user, comprising a trunk having a front end and a rear end, a seat connected with the rear end of the trunk, and at least one belt connected with the trunk and hanged on the frame set.

In one embodiment, the trunk comprises a front pedestal, a rear pedestal, and a plate between the front pedestal and the rear pedestal, and the seat connects with the rear pedestal.

In one embodiment, the plate comprises a first bend portion, a second bend portion, and a bridge portion between the first bend portion and the second bend portion, in which the first bend portion connects with the front pedestal, and the second bend portion connects with the rear pedestal.

In one embodiment, the front pedestal comprises a front aperture, the rear pedestal comprises a rear aperture, and the at least one belt comprises a first belt passing through the rear aperture and a second belt passing through the front aperture.

In one embodiment, the hanging seat further comprises a pad connected with the front pedestal.

In one embodiment, the at least one belt is made to be elastic.

According to another embodiment of this invention, a training device is disclosed and comprises a conveyor belt, a handrail set, a supporting mechanism, and a hanging seat. The conveyor belt is used for a user walks on it in place for physical medicine or rehabilitation. The handrail set comprises two handrails respectively arranged at two sides of the conveyor belt. The supporting mechanism comprises a platen for supporting the conveyor belt and a frame work for supporting the handrail set. The hanging seat is hanged on the framework, and comprises a trunk having a front end and a rear end, a seat connected with the rear end of the trunk, and at least one belt connected with the trunk and hanged on the supporting mechanism.

In one embodiment, the framework comprises four vertical sticks displaced around the conveyor belt.

In one embodiment, the framework further comprise four extendable sticks, each extendable stick is arranged within one vertical stick and capable of being extended from or retrieved into the vertical stick, and the a first securing member is used to lock the position of the extendable stick.

In one embodiment, each handrail comprises at least one arm with a lower end pivotally connected to a top end of the extendable stick, and a second securing member is used to determine an angle between the arm and the extendable stick.

In one embodiment, the framework comprises two pairs of vertical sticks respectively arranged at a side of the conveyor belt, and each pair comprises an upper horizontal stick and a lower horizontal stick used to connect the two vertical sticks.

In one embodiment, the hanging seat further comprises two brackets, and each pair of vertical stick fixes with a supporting plate of one bracket via the upper horizontal stick and the lower horizontal stick.

In one embodiment, the bracket further comprises two extendable bars, each extendable bar is arranged within the supporting plate and capable of being extended from or retrieved into the supporting plate, and the a third securing member is used to lock the position of the extendable bar.

In one embodiment, a top end of the two extendable bars connects with a fixing bar.

In one embodiment, the fixing bar has two ends with each end connecting with a safety belt.

In one embodiment, the training device further comprises a plurality of step sensors arranged inside the platen for sensing whether the user steps forward and thus determining whether the conveyor belt is driven.

BRIEF DESCRIPTION OF THE DRAWINGS

FIGS. 2-4 shows the detail of the hanging seat of FIG. 1, in which FIG. 2 is a perspective view, FIG. 3 is a side view, and FIG. 4 is a top view.

DETAILED DESCRIPTION OF THE PREFERRED EMBODIMENT

Reference will now be made in detail to those specific embodiments of the invention. Examples of these embodiments are illustrated in accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

Figure 1:
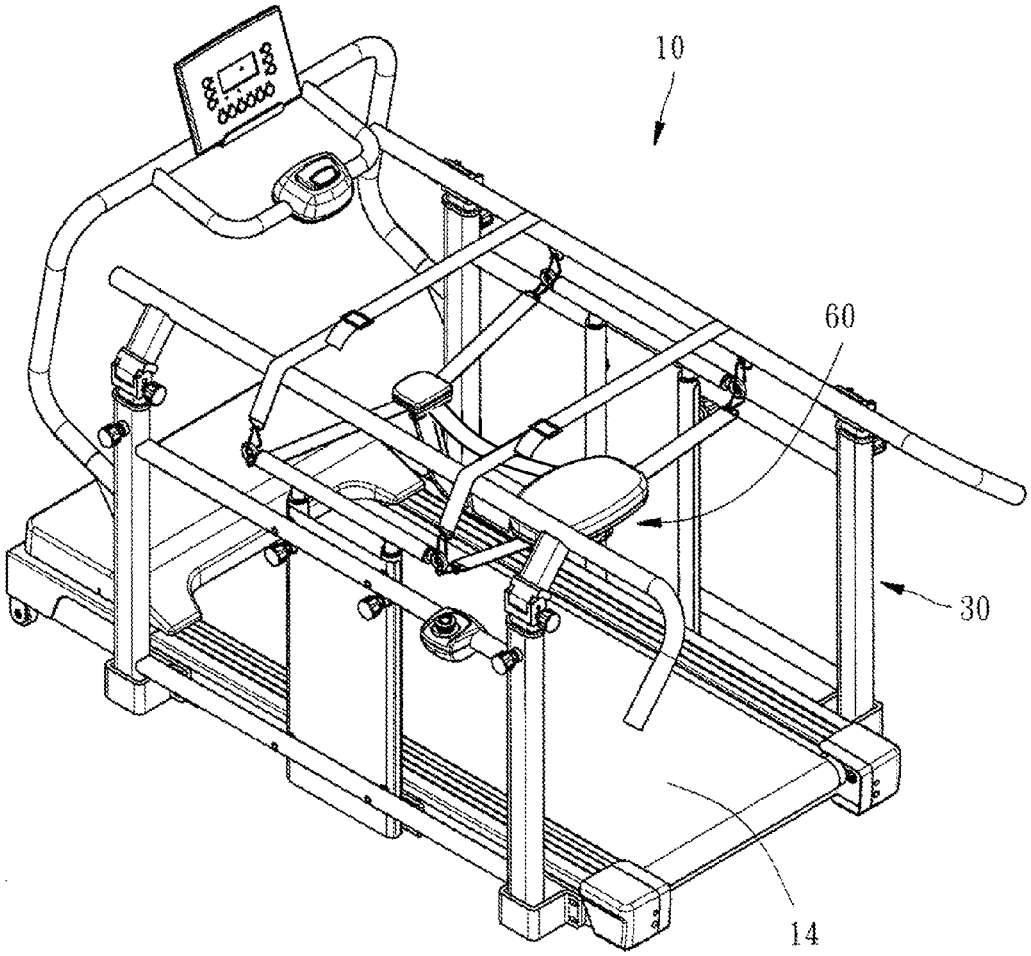
FIG. 1 is a perspective view showing a training device according to an embodiment of the present invention.

Referring to FIG. 1, a training device 10, such as a walk-training device 10 or a treadmill 10, is disclosed according to a preferred embodiment of this invention. Preferably, the training device 10 can be used for physical medicine and rehabilitation, for example, to strengthen legs of wounded, ill, elderly, or weak people. In some embodiments, the training device 10 can be used for learning to walk. Preferably, the training device 10 comprises a conveyor belt 30 allowing a user to walk or run on it, a frame set 12 arranged around the conveyor belt 30 for providing support, and a hanging seat 60 hanged on the frame set 12 for supporting the user.

Figure 2:
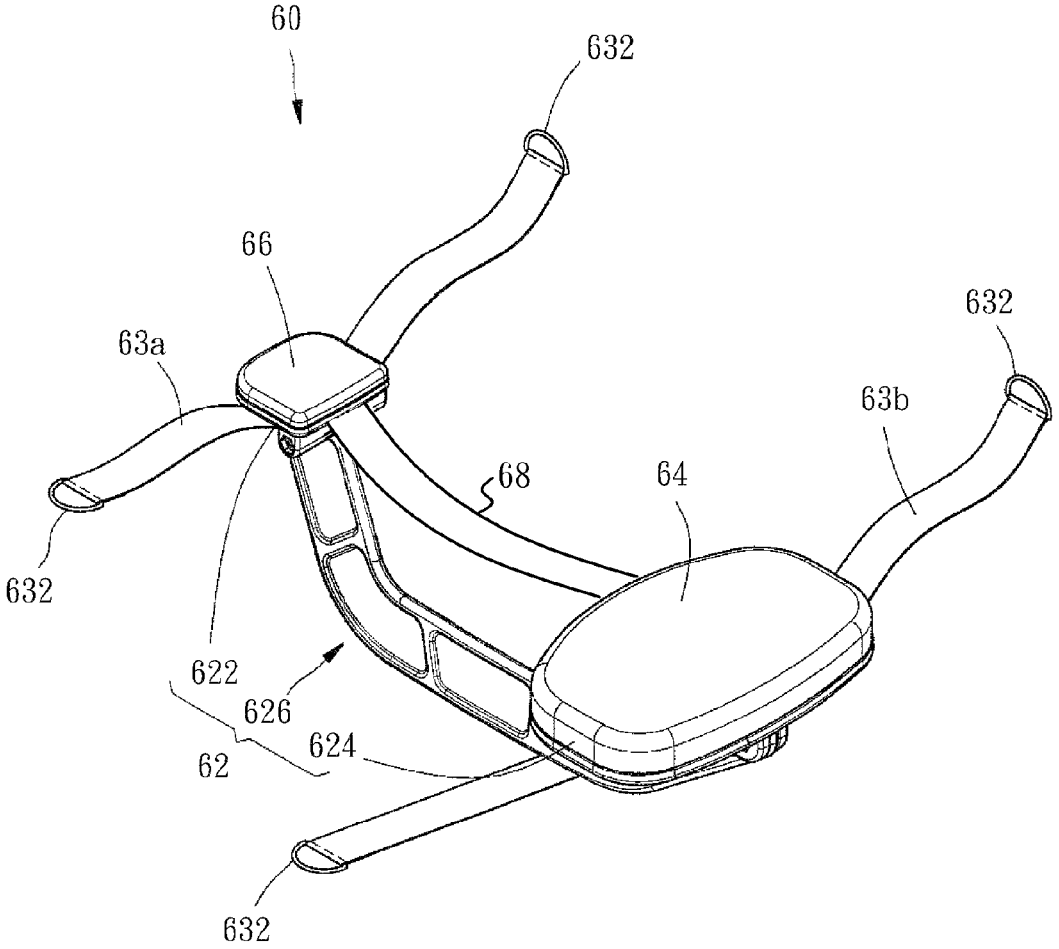
Figure 3:
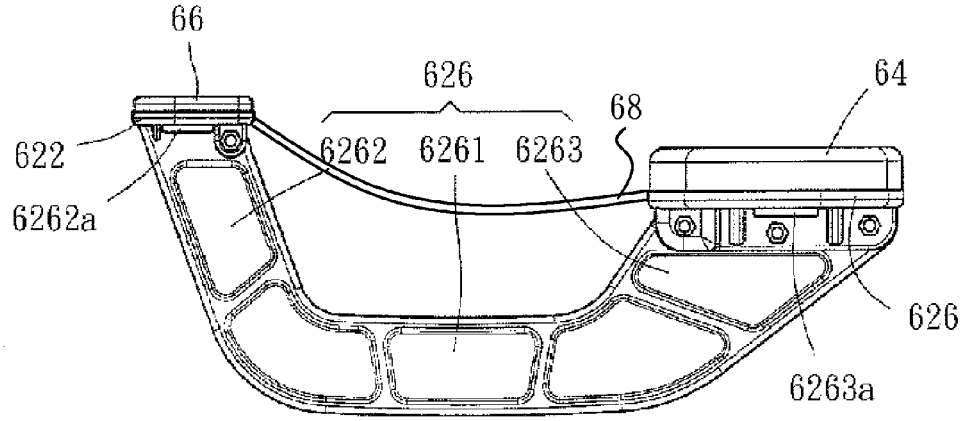
Figure 4:
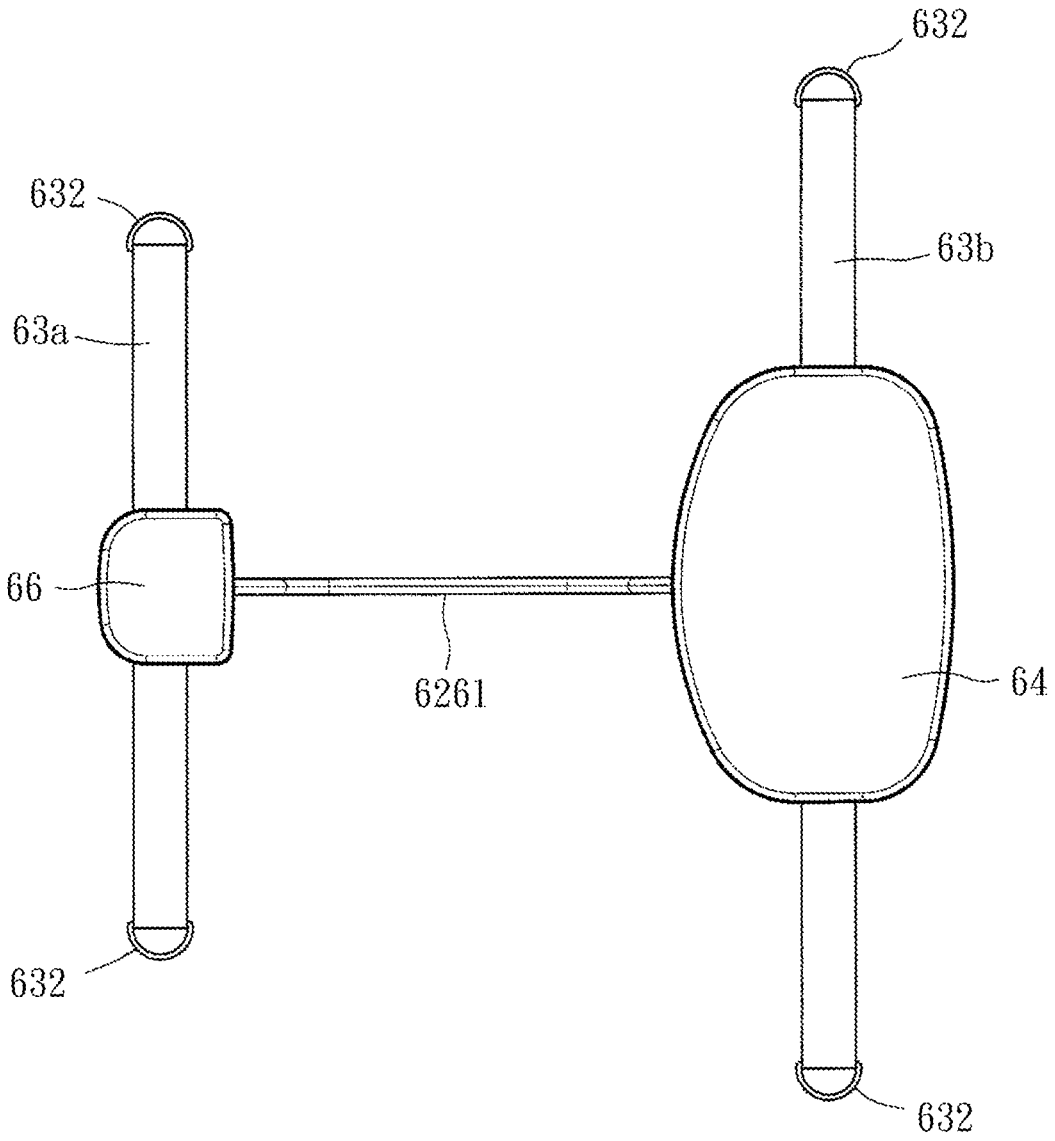

Referring to FIGS. 2-4, a hanging seat 60 is disclosed according to a preferred embodiment of this invention, in which FIG. 1 is a perspective view, FIG. 2 is a side view, and FIG. 3 is a top view. The hanging seat 60 is arranged above the conveyor belt 30 and mainly comprises a trunk 62, a seat 64 connected to the trunk 230, and a first belt 63*b* for hanging on the frame set 12. The user stands on the conveyor belt 30 with hips above the trunk 64 and legs straddled at two sides of the trunk 64, and when feeling tired, he or she may sit on the seat 64. Alternatively, the user may sit on the seat 64 and then walks on the conveyor belt 30. In addition, the user's one or two hands may hold the frame set 14.

In addition, the trunk 230 may comprise a plate 626 with two ends in which one end connected to a front pedestal 622 and the other end connected to a rear pedestal 624. The seat 64 is arranged on the rear pedestal 624. The plate 626 may comprise, but is not limited to, a bridge portion 6261, a first bend portion 6262, and a second bend portion 6263. In another embodiment, the plate 626 merely comprises the bridge portion 6261. In this embodiment, the first bend portion 6262 connects with the front pedestal 622, the second bend portion 6263 connects with the rear pedestal 624, and the bridge portion 6261 is between the first bend portion 6262 and the second bend portion 6263.

Further, the hanging seat 60 may further comprise a pad 66 arranged on the front pedestal 622. The pad 66 may be helpful to balance the hanging seat 60. In some embodiments of this invention, the pad 66 is omitted. Preferably, the size of the front pedestal 622 may be smaller than or equal to the size of the rear pedestal 624. The size of the pad 66 may be smaller than or equal to the size of the seat 64.

Preferably, the second bend portion 6263 has a rear aperture 6263*a*, and the first belt 63*b* passes through the rear aperture 6263*a*. The first belt 63*b* may hang on the frame set 12 through two buckles 632 respectively arranged at its two ends.

Furthermore, the hanging seat 60 may further comprise a second belt 63*a*. The first bend portion 6262 has a front aperture 6262*a*, and the second belt 63*a* passes through the front aperture 6262*a*. The second belt 63*a* may hang on the frame set 12 through two buckles 632 respectively arranged at its two ends.

Additionally, the hanging seat 60 may further comprise a protecting belt 68, which comprises two ends respectively connected the front pedestal 622 and the rear pedestal 624. The protecting belt 68 is used to avoid the user to collide the trunk if he or she falls down.

Notice that the connection between the belts 63*a*/63*b* and the frame set 12 is not limited to the above-mentioned methods, e.g., through the buckles, and which can be replaced by other methods known in the art. In addition, the number of the belts 63*a*/63*b* is also not limited. For example, four belts could be employed in which each belt has two ends with one end connected to the trunk 62 and the other end connected to the frame set 12.

The plate 626 or the bridge portion 6261 is preferably made to be thin or not too thick, such that the plate 626 will not interfere with the user's legs, and the user feels free while she or he steps on the conveyor belt 30. The front pedestal 622 and the rear pedestal 624 respective fixes with the plate 626, e.g, through the first bend portion 6262 and the second bend portion 6263. The fixing may be made by, for example but is not limited to, screwing, welding, fitting, or combinations thereof. In an embodiment, the plate 626, the front pedestal 622, and the rear pedestal 624 are integrally made as a whole. The plate 626 may be made of a firm and solid material, e.g., plastics. The plate 626 may be arranged at the direction so that its lengthwise dimension is parallel to the lengthwise dimension of the conveyor belt 30. The first belt 63*b* and/or the second belt 63*a* may be made to be elastic or made of an elastic material, and the elasticity of which may be strong, medium, or weak. If necessary, the hanging seat 60 can be detached from the frame set 12, so that the training device 10 is used for general people or a person who has recovered the strength to an extent.

Figure 5:
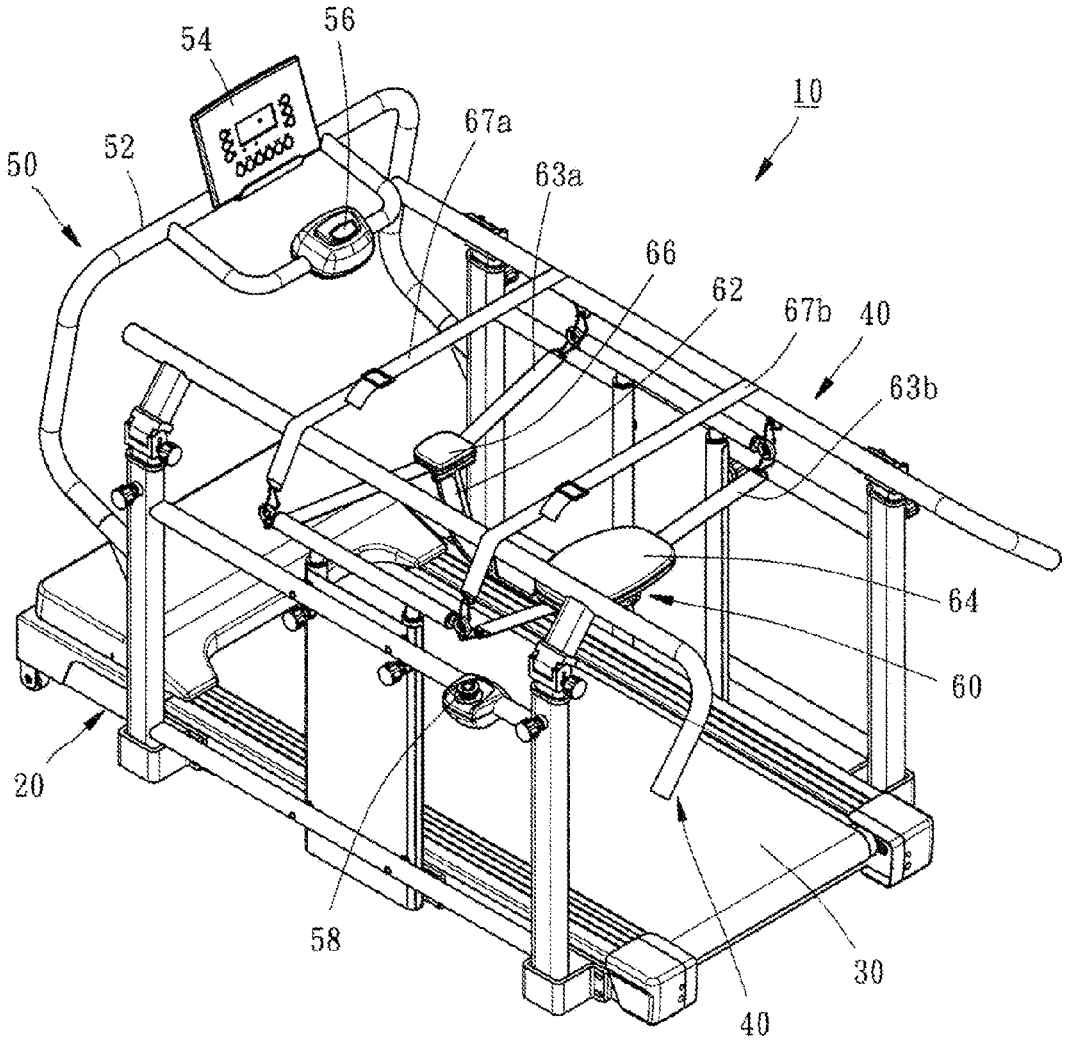
FIG. 5 is a perspective view showing a training device according to another embodiment of the present invention.

Referring to FIG. 5, a training device 10 is disclosed according to another preferred embodiment of this invention. This embodiment has a hanging seat 60 same or similar to that shown in FIGS. 1-4, as well as providing more detail of other mechanisms. As shown in FIG. 5, the training device 10 comprises a supporting mechanism 20, a conveyor belt 30, a handrail set 40, and a hanging seat 60.

Figure 6:
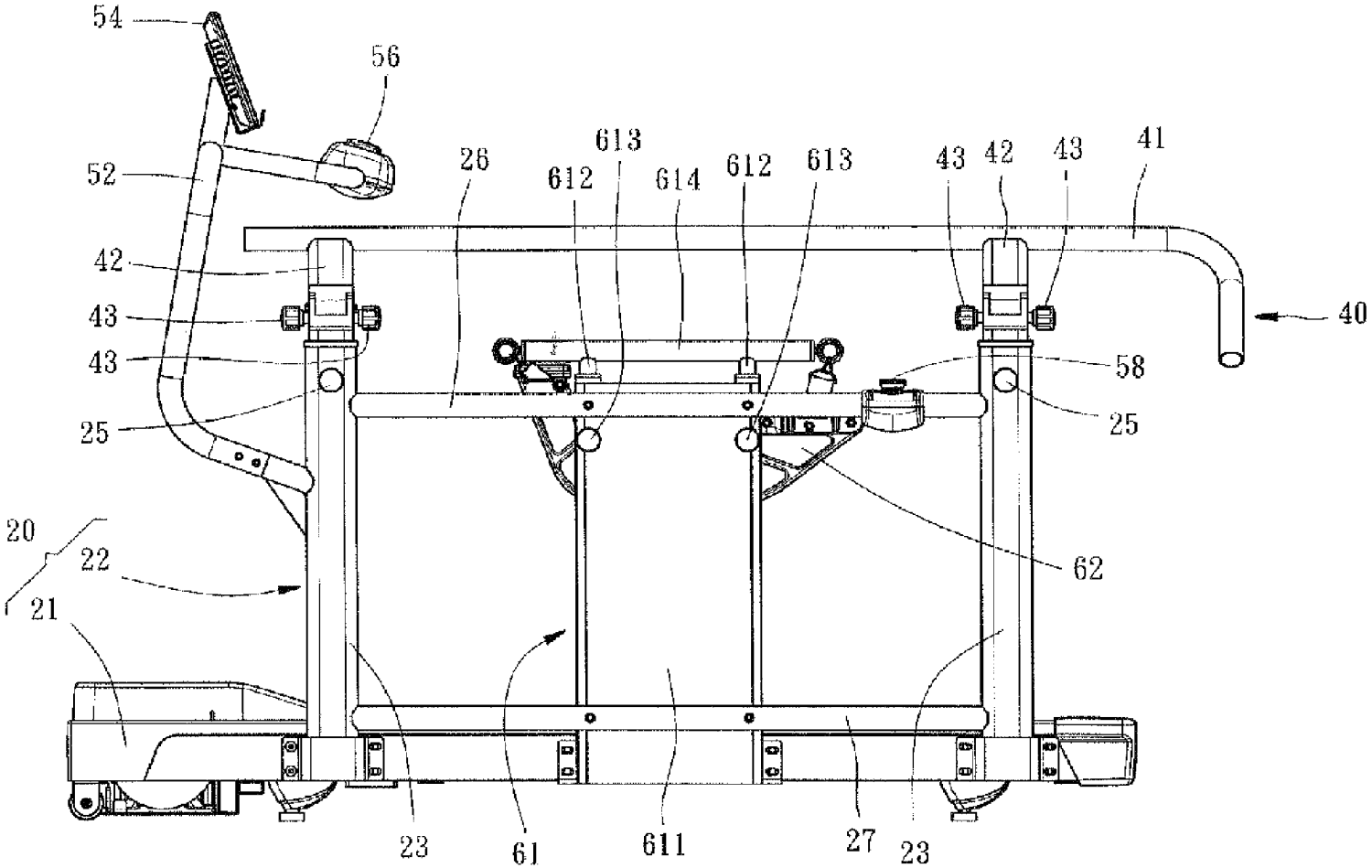
FIG. 6 is a side view of FIG. 5.
Figure 7:
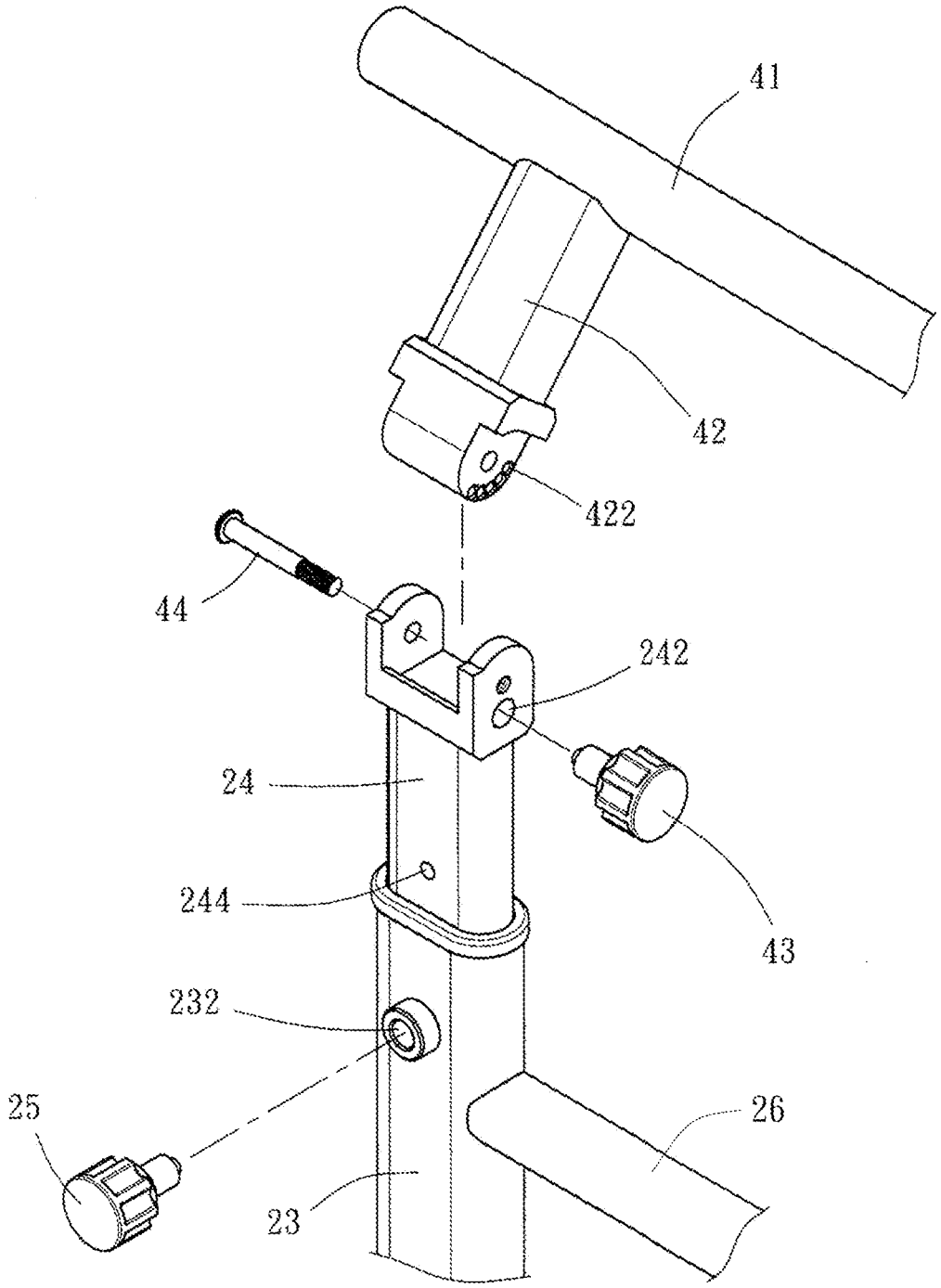
FIGS. 7-9 shows some details of FIG. 6.

FIG. 6 is a side view of the training device 10 shown in FIG. 5, and FIG. 7 shows the connection between the handrail set 40 and the supporting mechanism 20. Referring to FIGS. 6 and 7, the supporting mechanism 20 may comprise, but is not limited to, a platen 21 and a framework 22. The platen 21 is arranged on a supporting plane, such as ground. The framework 22 may comprise four vertical sticks 23 with each vertical stick 23 comprising an extendable stick 24. The extendable stick 24 is arranged inside the vertical stick 23 and can be extended from or retrieved into the vertical stick 23. The four vertical sticks 23 may be disposed around the conveyor belt 30, for example, at four corners around the conveyor belt 30, with each side of the conveyor belt 30 comprising a pair of vertical sticks 23. In addition, the framework 22 may further comprise an upper horizontal stick 26 and a lower horizontal stick 27 respectively arranged at upper and lower position of each pair of vertical sticks 23 for connecting its two vertical sticks 23. Each vertical stick 23 comprise a first hole 232 and a first securing member 25 mounted on the first hole 232, and each extendable stick 24 comprises a first securing hole 244. The first securing member 25 is used to lock the extendable stick 24 so that it cannot slide within the vertical stick 23. For example, the first securing member 25 may plug into the first securing hole 244 to lock the extendable stick 24.

In addition, the conveyor belt 30 is arranged above the platen 21 and is driven to run by a driving mechanism such as a motor inside of the platen 21.

Figure 8:
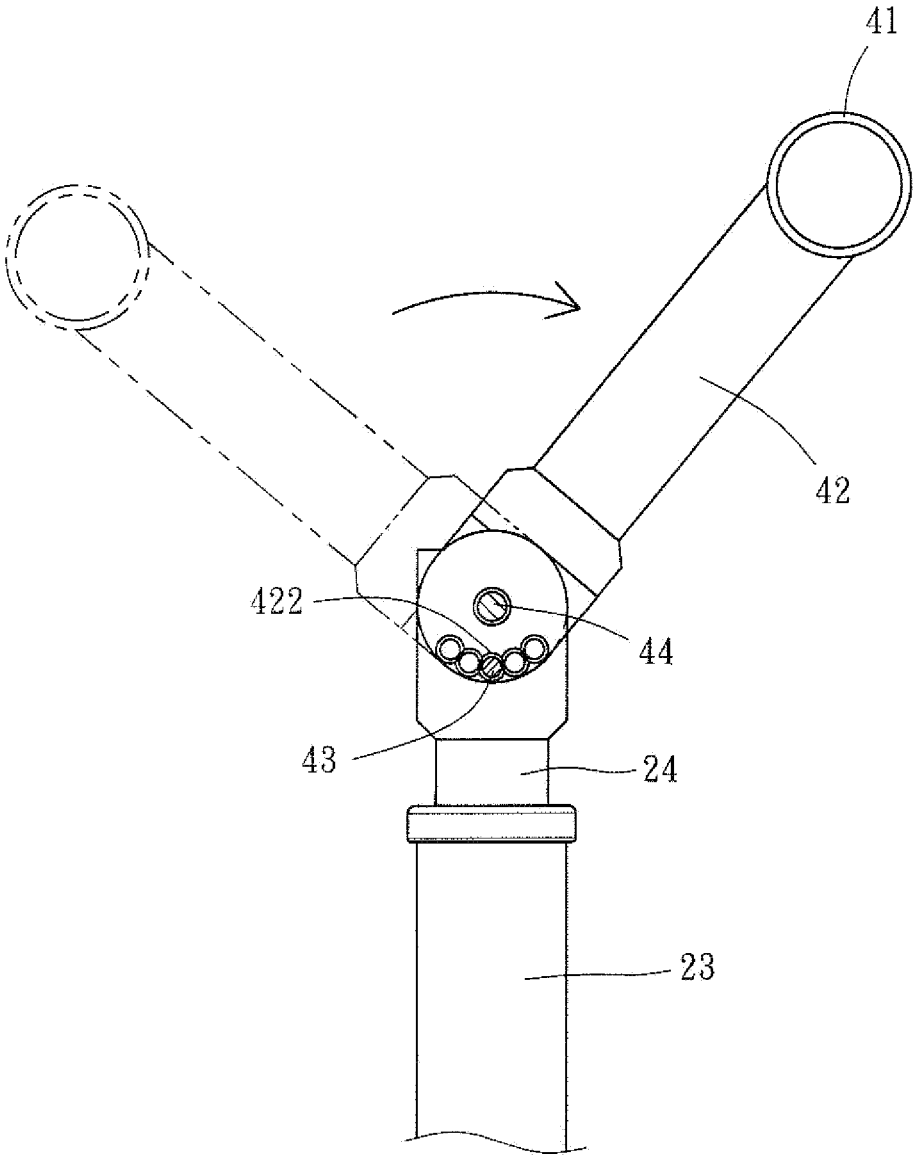

Referring to FIGS. 6, 7, and 8, the handrail set 40 comprises two handrails 41 with each comprising two arms 42, in which each arm 42 has one end connected to the handrail 40 and the other end pivotally mounted on one extendable stick 24 by a shaft 44. Further, the lower end of each arm 42 comprises a plurality of second securing holes 422, and a second securing member 43 is used to plug into one of the second securing holes 422, so as to determine an angle between the arm 42 and the vertical stick 23 or the extendable stick 24.

Referring to FIG. 5, the training device 10 may further comprise a display unit 50, which comprises a frame 52 and a control panel 54. The frame 52 fixes with the framework 22 of the supporting mechanism 20 and arranged at the front of the conveyor belt 30. The display panel 54 fixes with the frame 52 and can be used to set parameters of the conveyor belt 30, e.g., speed, time, tilting angle, and so forth. An emergency stop button 56 may be arranged at the frame 52 for urgently stopping the conveyor belt 30. An auxiliary emergency stop button 58 may be arranged at one of the upper horizontal stick 26 for also urgently stopping the conveyor belt 30. In some embodiments, the emergency stop button 56 and the auxiliary emergency stop button 58 are arranged at other positions.

Referring to FIGS. 5, 6, 9, and 10, the hanging seat 60 comprises a trunk 62, a first belt 63*b*, a second belt 63*a*, and a seat 64.

In addition, in this embodiment, the hanging seat comprises two brackets 61 respectively arranged at two sides of the conveyor belt 30. Each bracket 61 comprises a supporting plate 611, two extendable bars 612, two fixing bars 614, and two third securing members 613. The supporting plate 611 fixes with the upper horizontal stick 26 and the lower horizontal stick 27, and has two third holes 615 with the third securing members 613 mounted thereon. Each extendable bar 612 can be slid within the supporting plate 611 and has a plurality of third securing holes 616. The third securing member 613 plugs one of the third securing holes 616, so as to lock the extendable bar 612 and determine the height of the extendable bar 612. The top ends of the two extendable bars 614 connect with a fixing bar 614, which has two ends and each end comprises a first buckle 617.

The trunk 62 is arranged above the conveyor belt 30. The rear end of trunk 62 connects with the seat 64. A pad 66 may be connected to the front end of the trunk 62 for better balance. The size of the pad 66 may be equal to or smaller than the size of the seat 64.

Figure 9:
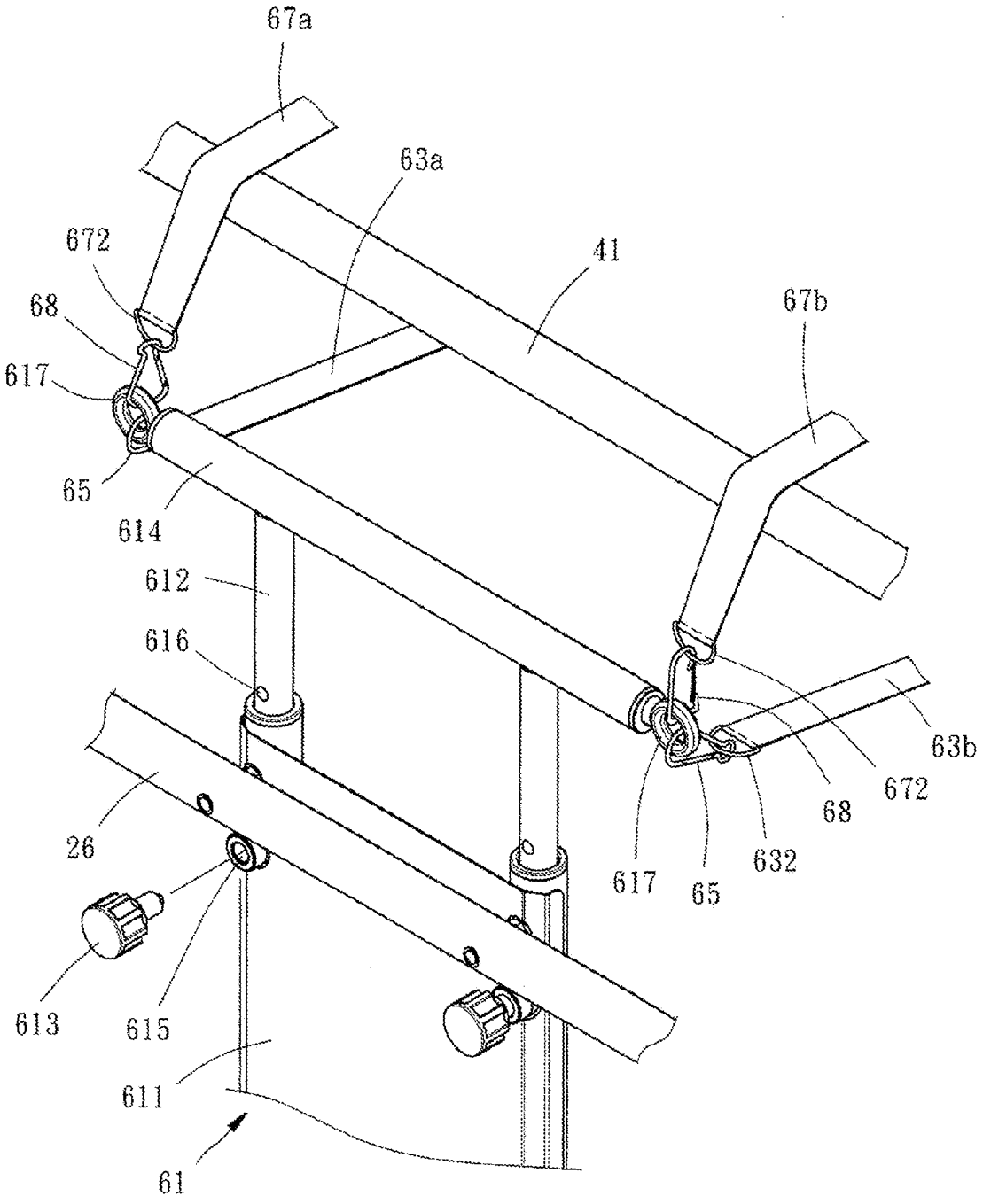

Two belts 63*a*/63*b* passes through the front end and the rear end of the trunk 62. Each belt 63*a*/63*b* has a second buckle 632 clasping the first buckle 617 of the fixing bar 614 via a first clasping ring 65, as shown in FIG. 9. By doing so, the two ends of each belt 63*a*/63*b* respectively hang on one bracket 61.

The details of the trunk 62 and other similar parts can be the same or similar to the description as discussed in FIGS. 1-4.

For more safety, two safety belts 67*a*/67*b* may be arranged on the handrail 41, respectively near the front and the rear of the seat 60. Each safety belt 67*a*/67*b* has two ends with each end comprising a third buckle 672. The third buckle 672 clasps the first buckle 617 via the second clasping ring 68, as shown in FIG. 9. The safety belts 67*a*/67*b* may be made to be elastic, the elasticity of which may be strong, medium, or weak.

Figure 10:
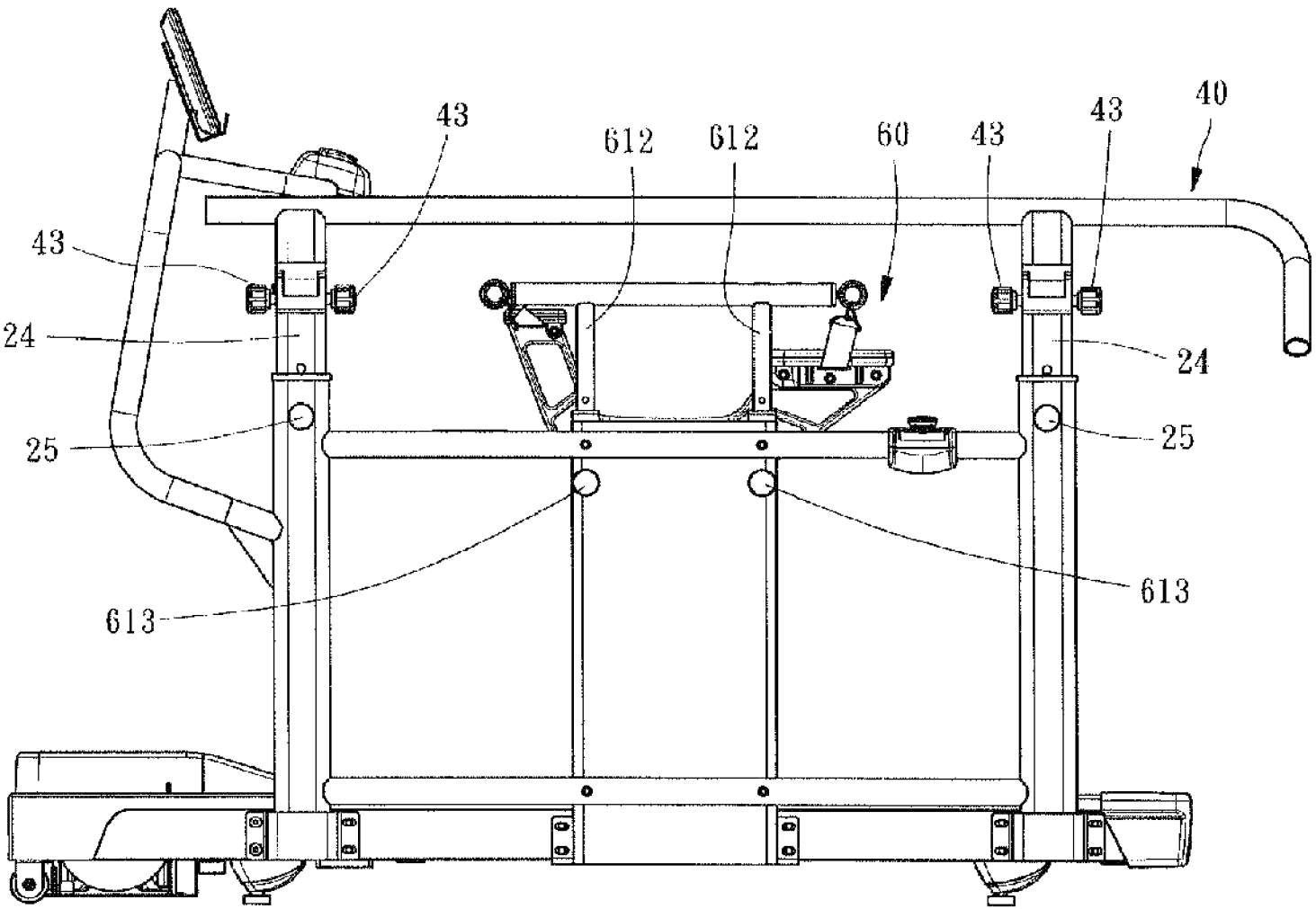
FIG. 10 shows the height of the extendable stick 24 of the training device can be adjusted.
Figure 11:
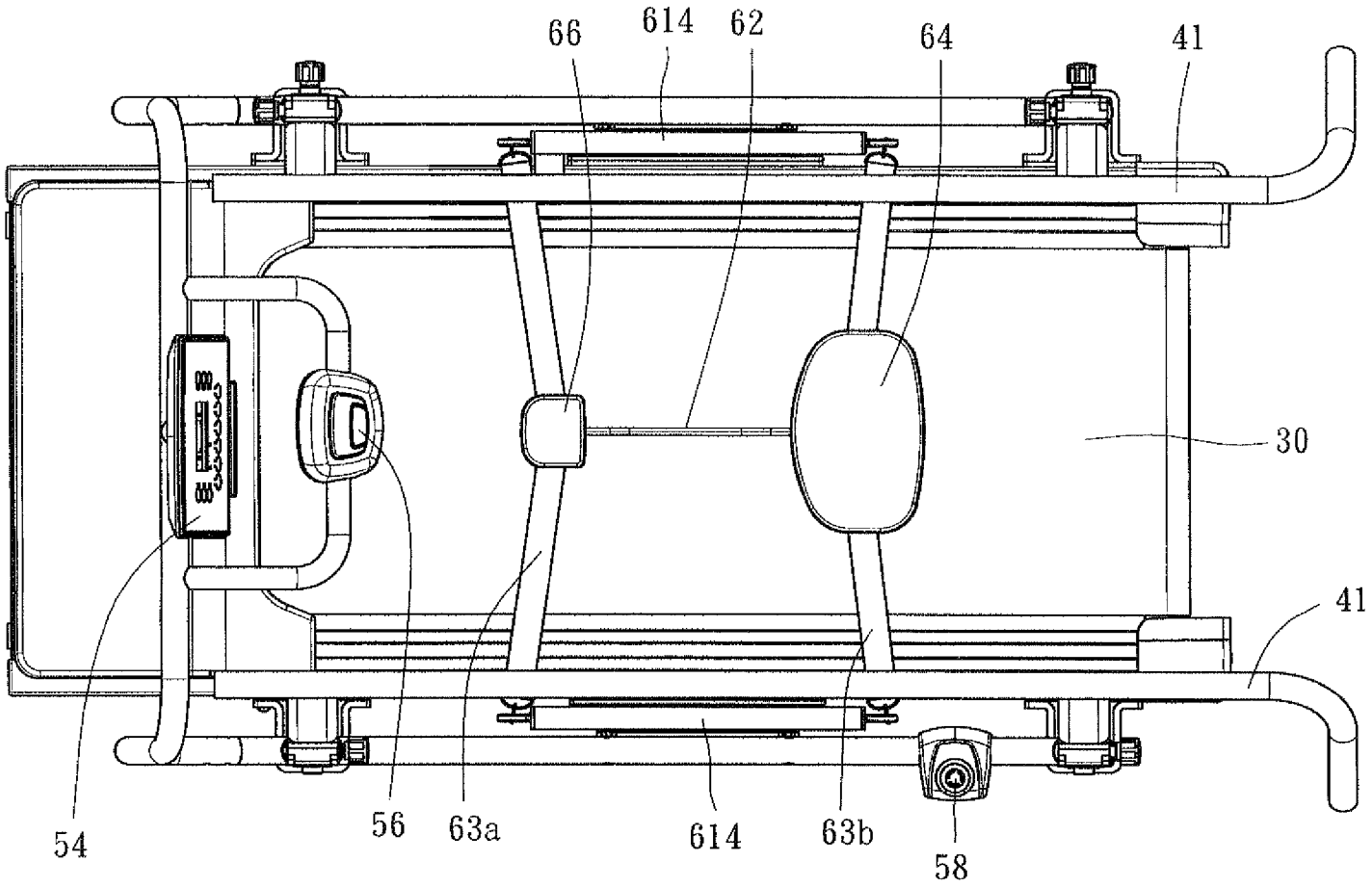
FIG. 11 shows the distance between two handrails 41 of the training device can be adjusted.

While using the training device 10, the handrail set 40 may be adjusted. In detail, the first securing member 25 is firstly released from the first securing hole 244, so that the extendable stick 24 can be adjusted to a proper height, as shown in FIG. 10. After adjustment, the first securing member 25 plugs into the corresponding first securing hole 244, so as to lock the extendable stick 24. As shown in FIGS. 7, 8, and 11, the second securing member 43 is released from the second securing hole 422, so that the handrail 40 can be adjusted to a proper angle through the arm 42. After adjustment, the second securing member 43 plugs into the corresponding second securing hole 422, so as to lock the angle between the arm 42 and the extendable stick 24.

The height of the seat 40 is also can be adjusted. In detail, the third securing member 613 is firstly released from the third securing hole 616, so that the extendable bar 612 can be adjusted to a proper height, as shown in FIGS. 9 and 10. After adjustment, the third securing member 613 plugs into the corresponding third securing hole 616, so as to lock the extendable bar 612.

The safety belts 67*a* and 67*b* are used to avoid the user falling down, and they can be removed if they are considered to be unnecessary. The trunk 62 may feature in plate-shaped and being made to be thin, so that the user will feel free while he or she steps on the conveyor belt 30. If the user is ill or feels exhausted, he or she may press the emergency stop button, and/or sit on the seat 64 for a while. Alternatively, the user may sit on the seat 64 and keep walking on the conveyor belt 30.

In addition, a plurality of pairs of step sensor (not shown) may be arranged inside the platen for sensing the steps of the user. The measurement results are fed back to the control panel 54, and a proper running mode of the training device 10 may be determined by the measurement results, automatically estimated by the system. For example, the step sensors can be used to check whether the user steps forward or not and the distance between the steps, so as to determine if the conveyor belt 30 is driven and/or determining other parameters.

Figure 12:
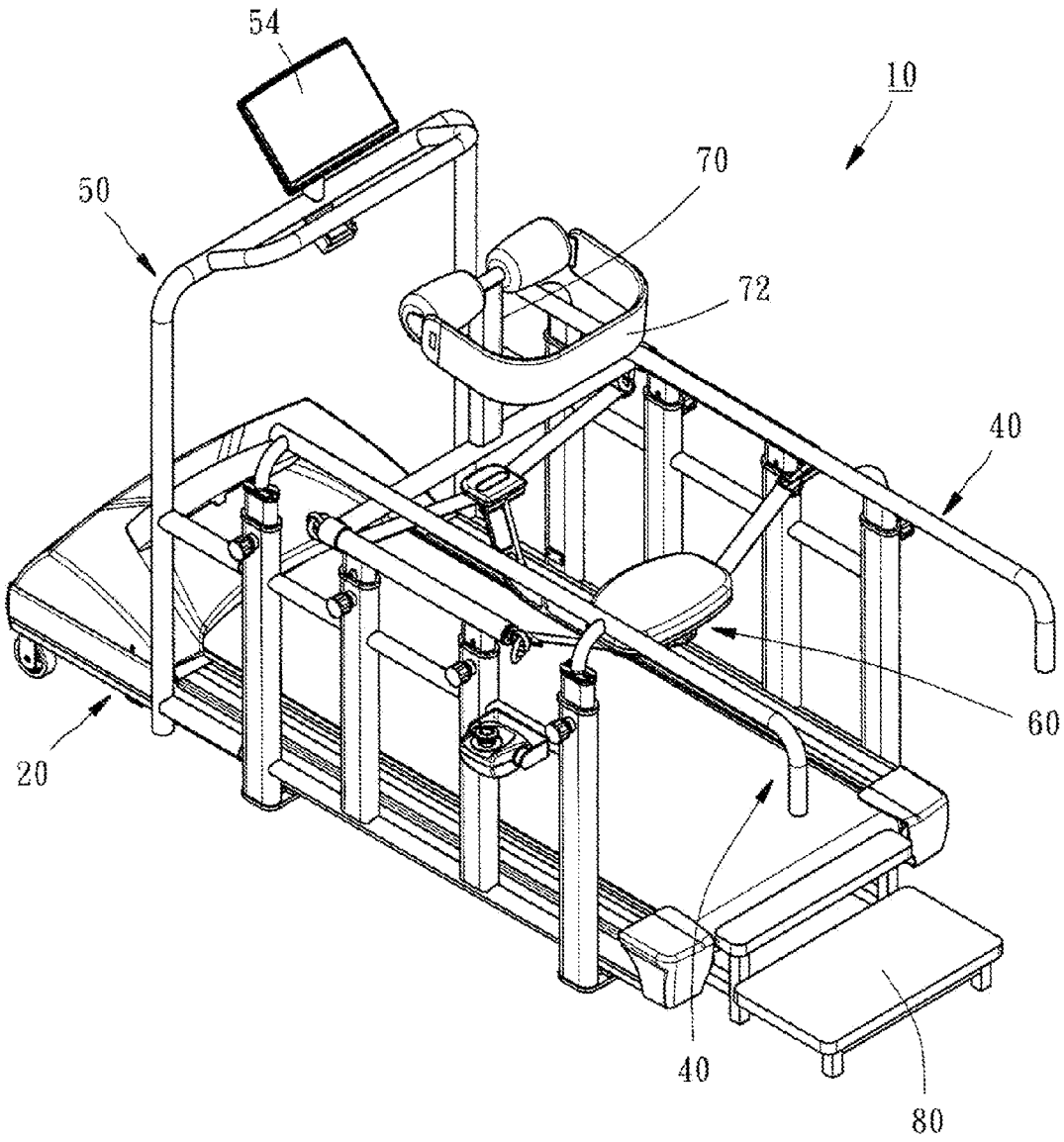
FIG. 12 is a perspective view showing a training device according to another embodiment of the present invention.

FIG. 12 shows another training device 10 according to another preferred embodiment of this invention. In this embodiment, a rack 70 is connected to the fixing bar 614, and the upper portion of the rack 70 has a ring-shaped band 72 clasping thereon. The ring-shaped band 72 is used to replace the safety belts 67*a*/67*b* as shown in FIG. 8. In addition, a pedal 80 may be arranged to the rear end of the supporting mechanism for convenience.

Accordingly, the embodiments of the present invention provide training devices with particular design for wounded, elderly, weak, or ill people, e.g., to avoid them falling down on the conveyor belt. Additionally, the training devices of the embodiments of the present invention have a simple mechanism and are easy to operate.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A training device, comprising:

a conveyor belt on which a user walks in place for physical medicine or rehabilitation; and a frame set arranged around the conveyor belt for providing a support; and a hanging seat hanged on the frame set for supporting the user, comprising:

a trunk having a front end and a rear end;

a seat connected with the rear end of the trunk; and at least one belt connected with the trunk and hanged on the frame set;

wherein the trunk comprises a front pedestal, a rear pedestal, and a plate between the front pedestal and the rear pedestal, and the seat connects with the rear pedestal.

2. The training device as set forth in claim 1, wherein the plate comprises a first bend portion, a second bend portion, and a bridge portion between the first bend portion and the second bend portion, in which the first bend portion connects with the front pedestal, and the second bend portion connects with the rear pedestal.

3. The training device as set forth in claim 2, wherein the front pedestal comprises a front aperture, the rear pedestal comprises a rear aperture, and the at least one belt comprises a first belt passing through the rear aperture and a second belt passing through the front aperture.

4. The training device as set forth in claim 1, wherein the hanging seat further comprises a pad connected with the front pedestal.

5. The training device as set forth in claim 1, wherein the at least one belt is made to be elastic.

6. A training device, comprising:

a conveyor belt on which a user walks in place for physical medicine or rehabilitation;

a handrail set comprising two handrails respectively arranged at two sides of the conveyor belt;

a supporting mechanism comprising a platen for supporting the conveyor belt and a frame work for supporting the handrail set; and a hanging seat hanged on the framework, comprising:

a trunk having a front end and a rear end;

a seat connected with the rear end of the trunk; and at least one belt connected with the trunk and hanged on the supporting mechanism;

wherein the trunk comprises a front pedestal, a rear pedestal, and a plate between the front pedestal and the rear pedestal, and the seat connects with the rear pedestal.

7. The training device as set forth in claim 6, wherein the plate comprises a first bend portion, a second bend portion, and a bridge portion between the first bend portion and the second bend portion, in which the first bend portion connects with the front pedestal, and the second bend portion connects with the rear pedestal.

8. The training device as set forth in claim 7, wherein the front pedestal comprises a front aperture, the rear pedestal comprises a rear aperture, and the at least one belt comprises a first belt passing through the rear aperture and a second belt passing through the front aperture.

9. The training device as set forth in claim 6, wherein the hanging seat further comprises a pad connected with the front pedestal.

10. The training device as set forth in claim 9, wherein the framework comprises four vertical sticks displaced around the conveyor belt.

11. The training device as set forth in claim 10, wherein the framework further comprise four extendable sticks, each extendable stick is arranged within one vertical stick and capable of being extended from or retrieved into the vertical stick, and the a first securing member is used to lock the position of the extendable stick.

12. The training device as set forth in claim 11, wherein each handrail comprises at least one arm with a lower end pivotally connected to a top end of the extendable stick, and a second securing member is used to determine an angle between the arm and the extendable stick.

13. The training device as set forth in claim 12, wherein the framework comprises two pairs of vertical sticks respectively arranged at a side of the conveyor belt, and each pair comprises an upper horizontal stick and a lower horizontal stick used to connect the two vertical sticks.

14. The training device as set forth in claim 13, wherein the hanging seat further comprises two brackets, and each pair of vertical stick fixes a supporting plate of one bracket via the upper horizontal stick and the lower horizontal stick.

15. The training device as set forth in claim 14, wherein the bracket further comprises two extendable bars, each extendable bar is arranged within the supporting plate and capable of being extended from or retrieved into the supporting plate, and the a third securing member is used to lock the position of the extendable bar.

16. The training device as set forth in claim 15, wherein a top end of the two extendable bars connects with a fixing bar.

17. The training device as set forth in claim 16, wherein the fixing bar has two ends with each end connecting with a safety belt.

* * * * *